US011542715B2

(12) United States Patent
Matthews

(10) Patent No.: US 11,542,715 B2
(45) Date of Patent: Jan. 3, 2023

(54) COUPLING SYSTEM

(71) Applicant: Kingsmead Developments (SW) Limited, Devon (GB)

(72) Inventor: Stephen John Matthews, Devon (GB)

(73) Assignee: Kingsmead Developments (SW) Limited, Devon (GB)

( * ) Notice: Subject to any disclaimer, the term of this patent is extended or adjusted under 35 U.S.C. 154(b) by 198 days.

(21) Appl. No.: 16/720,787

(22) Filed: Dec. 19, 2019

(65) Prior Publication Data

US 2020/0199895 A1 Jun. 25, 2020

(30) Foreign Application Priority Data

Dec. 20, 2018 (GB) ..... 1820833

(51) Int. Cl.
*E04G 7/30* (2006.01)
*E04G 1/04* (2006.01)
*E04G 7/32* (2006.01)

(52) U.S. Cl.
CPC ..... *E04G 7/307* (2013.01); *E04G 1/04* (2013.01); *E04G 7/32* (2013.01)

(58) Field of Classification Search
CPC .. E04G 1/04; E04G 7/307; E04G 7/32; E04G 7/306; E04G 7/302; E04G 7/30; E04G 7/14; E04G 7/20; E04G 7/22; E04G 7/12; Y10T 403/30; Y10T 403/7105; Y10T 403/71
See application file for complete search history.

(56) References Cited

U.S. PATENT DOCUMENTS 3,992,118 A * 11/1976 Siegers ..... E04G 7/308 182/186.7
4,443,127 A * 4/1984 de Leeuw ..... E04G 7/308 52/81.3
4,715,474 A * 12/1987 Wehmeyer ..... E04G 7/306 403/268

(Continued)

FOREIGN PATENT DOCUMENTS

GB 1463867 A 2/1977
JP H08270214 A 10/1996
NL 8600867 A 11/1987

OTHER PUBLICATIONS

Patents Act 1977: Search Report under Section 17, GB Application No. 1820833.0 dated Jun. 13, 2019, 1 page.

*Primary Examiner* — Daniel P Cahn
*Assistant Examiner* — Shiref M Mekhaeil

(57) ABSTRACT

A coupling system (10) for coupling together elongate members (6) is described. The coupling system (10) comprises a mounting member (1) having a mounting surface (8). A first locating member (2) is mounted on the mounting member (1) and a second locating member (2) is adapted to be mounted on the mounting member (1), in use. A number of support members (3) are provided and each support member (3) comprises two locating member engagement formations (31, 32), a mounting member engagement surface (27) and a first elongate member support formation (28). The engagement surface (27) of a support member (3) is adapted to be engaged with the mounting surface (8) of the mounting member (1) and one locating member engagement formation (31, 32) is adapted to be engaged with each locating member (2) to mount the support member (3) on the mounting member (1).

15 Claims, 23 Drawing Sheets

(56) References Cited

U.S. PATENT DOCUMENTS 5,285,869 A * 2/1994 Rock ..... E04G 7/20 403/373
5,560,730 A * 10/1996 Gillard ..... E04G 7/307 403/294
5,615,968 A * 4/1997 Verenski ..... F16B 2/065 403/312
5,894,909 A * 4/1999 Cornish ..... E04G 7/308 182/186.7
5,918,700 A * 7/1999 Gregory ..... E04G 7/28 182/186.7
6,053,639 A * 4/2000 Chen ..... G02B 6/3825 385/87
D488,714 S * 4/2004 Schengrund ..... D8/382
6,722,471 B2 * 4/2004 Wolfe ..... E04G 5/16 182/186.7
D656,814 S * 4/2012 Bauer ..... D8/382
8,944,415 B2 * 2/2015 Sirotin ..... E04H 17/20 256/26
9,103,448 B2 * 8/2015 Witkowski ..... F16K 5/0471
10,047,531 B2 * 8/2018 Rogers ..... E04G 7/302
2002/0079165 A1 * 6/2002 Wolfe ..... E04G 7/307 182/186.7
2002/0094228 A1 * 7/2002 Krauss ..... F16D 1/087 403/84
2003/0138293 A1 * 7/2003 Sciortino ..... F16B 7/0426 403/385
2012/0219354 A1 * 8/2012 Bauer ..... F16B 2/12 403/187
2013/0146825 A1 * 6/2013 Buckingham ..... B66F 3/00 254/105
2014/0252038 A1 * 9/2014 De Rosa ..... B65D 47/2087 222/525
2014/0318895 A1 * 10/2014 Birk ..... E04G 3/22 182/222
2015/0225971 A1 * 8/2015 Gill ..... E04G 5/14 182/112
2015/0239098 A1 * 8/2015 Vincent ..... B25B 5/101 182/129
2016/0281375 A1 * 9/2016 Rogers ..... E04G 7/307
2016/0298343 A1 * 10/2016 Rogers ..... E04G 7/302
2017/0205013 A1 * 7/2017 Smith ..... F16L 41/065
2018/0119433 A1 * 5/2018 Mikic ..... E04G 5/046
2021/0025182 A1 * 1/2021 Bratland ..... E04G 11/48

* cited by examiner

COUPLING SYSTEM

FIELD OF THE INVENTION

The invention relates to a coupling system, and especially a coupling system for coupling together cylindrical elongate members, such as scaffolding tubes.

BACKGROUND TO THE INVENTION

Traditional scaffolding tubes are manufactured from metal poles which are usually steel and often galvanised to provide some protection from corrosion. While traditional steel tubes provide structural strength, they are relatively expensive to manufacture and difficult to recycle.

In addition, metal scaffolding has particular problems when used in hazardous environments, such as close to overhead electric power lines. In this case the metal scaffolding presents problems because it is an inherent conductor of electricity and there is a risk of electrocution to installers of the scaffolding or workers on the scaffolding if the scaffolding contacts the power lines. There is also a risk of shorting the overhead power cables if metal scaffolding touches them. An example of where this can be a serious problem in practice is where elevated access is required beside or on railway track that uses electrified overhead power lines.

The use of metal scaffolding may also be problematic in situations in proximity to explosive substances. In this case there is a risk of metal scaffolding causing a spark if it is accidentally struck with another metal object, such as a hammer or part of the scaffolding accidentally strikes another object during installation of the scaffolding.

Therefore, although metal scaffolding is structurally strong, there are situations where it is preferable not to use metal scaffolding or metal scaffolding simply cannot be used, for example, due to health and safety considerations.

In these situations it would be preferable to use a non-conducting material for the scaffolding. However, one of the advantages of metal tubing is that it can withstand the compressive loads applied when clamps are used to connect one scaffolding tube to another scaffolding tube. Unfortunately, tubes of non-metallic material such as plastics, are not sufficiently strong to withstand a compressive loading that is required to securely clamp one tube to another tube.

SUMMARY OF THE INVENTION

In accordance with an aspect, there is provided a coupling system for coupling together elongate members, the coupling system comprising:

- a mounting member having a mounting surface;
- a first locating member mounted on the mounting member;
- a second locating member adapted to be mounted on the mounting member, in use;
- a number of support members, each support member comprising two locating member engagement formations, a mounting member engagement surface and a first elongate member support formation; and wherein the engagement surface of a support member is adapted to be engaged with the mounting surface of the mounting member and one locating member engagement formation is adapted to be engaged with each locating member to mount the support member on the mounting member; and the first elongate member support formation on the support member is adapted to be engaged with an elongate member, in use.

Typically, the mounting surface of the mounting member is a curved surface and preferably, the mounting surface is cylindrical.

The mounting surface may extend around the mounting member.

Preferably, the engagement surfaces of at least two support members can be engaged with the mounting surface.

Typically, when an elongate member is engaged with the elongate member support formation on each support member, the elongate members extend from the mounting member at an angle to each other.

Preferably, the coupling system further comprises a number of blanking members, each blanking member having two locating member engagement formations and a mounting member engagement surface, and wherein one or more blanking members are engaged with the mounting surface in locations where a support member is not engaged with the mounting surface.

Typically, the second locating member comprises a first formation that engages with a second formation on the mounting member to secure the second locating member to the mounting member.

Preferably, one of the first and second formations is a channel and the other of the first and second formations is a first protrusion adapted to engage with the channel.

The first formation may be engaged with the second formation by relative rotational movement between the second locating member and the mounting member.

Preferably, one of the first and second formations comprises a detent formation to inhibit disengagement of the first and second formations. The detent formation may comprise a second protrusion in the channel which is engaged by the first protrusion before the first and second formations are fully engaged and an elastic deformation of a portion of at least one of the second locating member and the mounting member permits the first protrusion to move past the second protrusion and the first and second formations to fully engage with each other.

Typically, at least one of the locating member formations is generally wedge-shaped with the thinner end of the wedge adapted to be inserted first into one of the first and second locating members.

Typically, at least one of the first and second locating members is in the form of a collar adapted to be positioned over the mounting member. The first and second locating members may be identical to each other.

In one example of the invention, the mounting member may comprise a shoulder and the first locating member may be supported by the shoulder. The first locating member may engage with the shoulder.

Typically, the mounting member comprises a first tubular member and the mounting surface is the outside of the first tubular member. Typically, the first elongate member support formation comprises a second tubular member. Typically, the elongate member comprises a third tubular member.

The mounting member may further comprise at least one second elongate member support formation. The at least one second elongate member support formation may be an end of the first tubular member. Preferably, there are two second elongate member support formations, one at each end of the first tubular member.

Typically, when two or more elongate members are engaged with respective first support formations, in use, the longitudinal axes of the elongate members intersect each other at an angle of a multiple of 90 degrees.

Typically, when two or more elongate members are engaged with respective first and/or second support formations, in use, the longitudinal axes of the elongate members intersect each other at an angle of a multiple of 90 degrees.

Preferably, the mounting member has a longitudinal axis, and the first support formation has a longitudinal axis, such that when the support member is mounted on the mounting member, the longitudinal axis of the mounting member and the longitudinal axis of the first support formation intersect each other at 90 degrees.

Typically, the coupling system further comprises a securing device, and wherein the first support formation comprises a securing formation that accepts the securing device to secure an elongate member to the first locating formation, in use. The securing device may comprise a pin and the securing formation may comprise an aperture which is adapted to accept the pin and preferably, the pin is also adapted to engage with an elongate member to secure the elongate member to the first locating formation.

Typically, the elongate member may be inserted at least one of the first tubular member and the second tubular member, in use.

At least one of the first and the second tubular members may have a number of first internal formations protruding inwardly from an internal surface of the respective tubular member. The first internal formations may be in the form of ribs extending longitudinally along the internal surface of the respective tubular member. The first internal formations are typically circumferentially spaced around the inside of the tubular member and are preferably, spaced equidistantly around the inside of the respective tubular member.

Typically, at least one of the first and the second tubular members comprise a substantially cylindrical shell.

Preferably, the coupling system forms part of a scaffolding system. Typically, the elongate member is a scaffold tube.

Although the components of the coupling system could be manufactured from a metal, in one example of the invention, the coupling system is manufactured from a non-metallic material, and preferably an electrical insulator. More preferably, it may be manufactured from a plastics material. For example, a thermoplastics material, such as high density polyethylene (HDPE).

Alternatively, the coupling system could be manufactured from any suitable non-metallic material, such as a thermosetting resin or plastic, or may be a composite material comprising two or more different materials. Where the material used is a plastics material, a resin or a composite material, the material may optionally include one or more fibre materials, such as glass fibre or aramid fibre.

BRIEF DESCRIPTION OF THE DRAWINGS

An example of a coupling system in accordance with the invention will now be described with reference to the accompanying drawings, in which.

DESCRIPTION OF PREFERRED EMBODIMENTS

Figure 1:
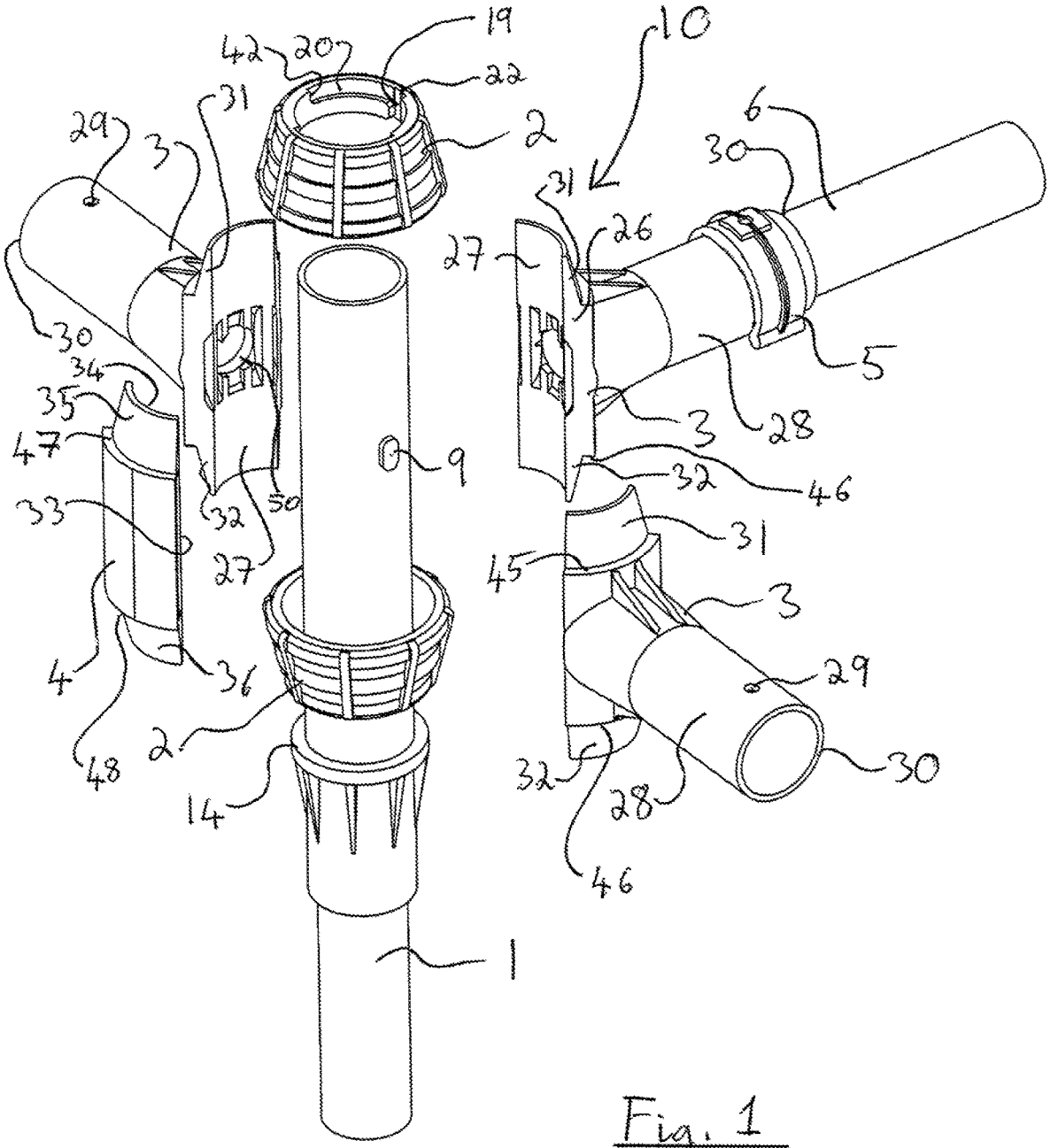
FIG. 1 is an exploded view of a first configuration of a coupling system with three support members.

FIG. 1 is an exploded view of the first configuration of a coupling system 10 comprising a mounting member 1, the first and second locating members in the form of two collars 2, three support members 3, a blanking plate 4, a securing clip 5 and an elongate tubular member in the form of a scaffolding tube 6.

The coupling system 10 is particularly suitable for coupling together scaffolding tubes, such as the scaffolding tube 6. In a preferred embodiment, the components of the coupling system 10, namely the mounting member 1, the collars 2, the support members 3, the blanking plates 4 and the securing clip 5 are all manufactured from a non-conducting material, such as a plastics material or a composite material that is non-conducting. Typically, the plastics material is a thermoplastics material, such as high density polyethylene (HDPE). The components are preferably manufactured from a recyclable material. In addition, the coupling system 10 is especially useful when used with scaffold tubes 6 that are manufactured from a non-conducting material, such as a plastics material. The scaffolding tube 6 and the components of the coupling system 10 may be manufactured from the same plastics materials. Alternatively, different components of the coupling system 10 and the scaffold tube 6 could be manufactured from different types of non-conducting material, such as different types of plastic material. The tubes 6 and/or components of the coupling system 10 may be manufactured from a composite material that could include one or more of a plastics material, glass fibres and aramid fibres, such as Kevlar®.

Figure 2A:
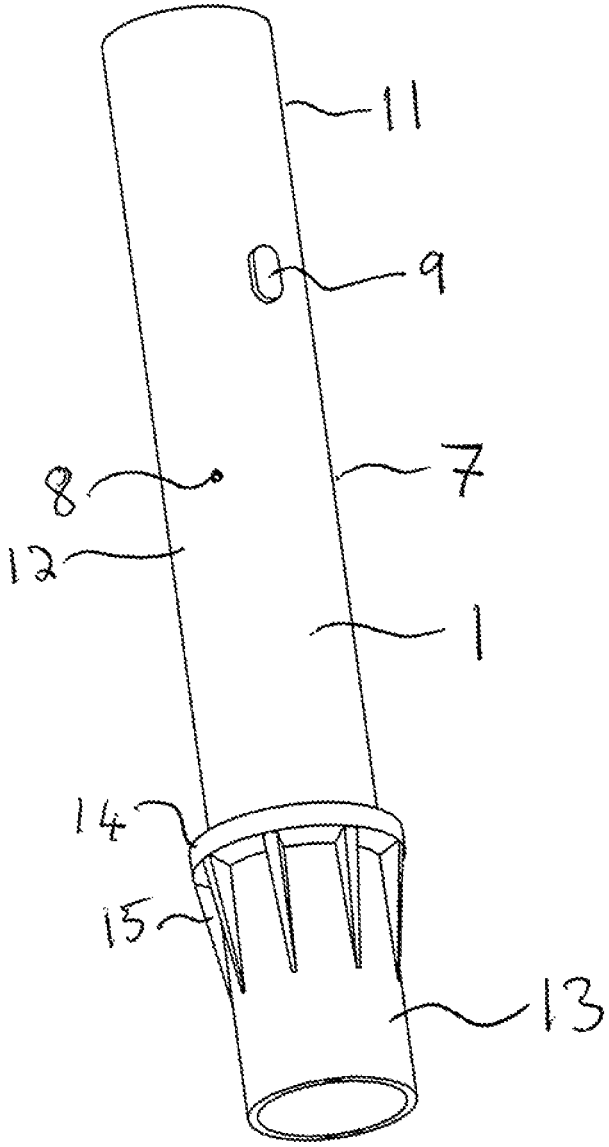
FIG. 2*a* is a perspective view of a mounting member for use with the coupling system shown in FIG. 1.
Figure 2B:
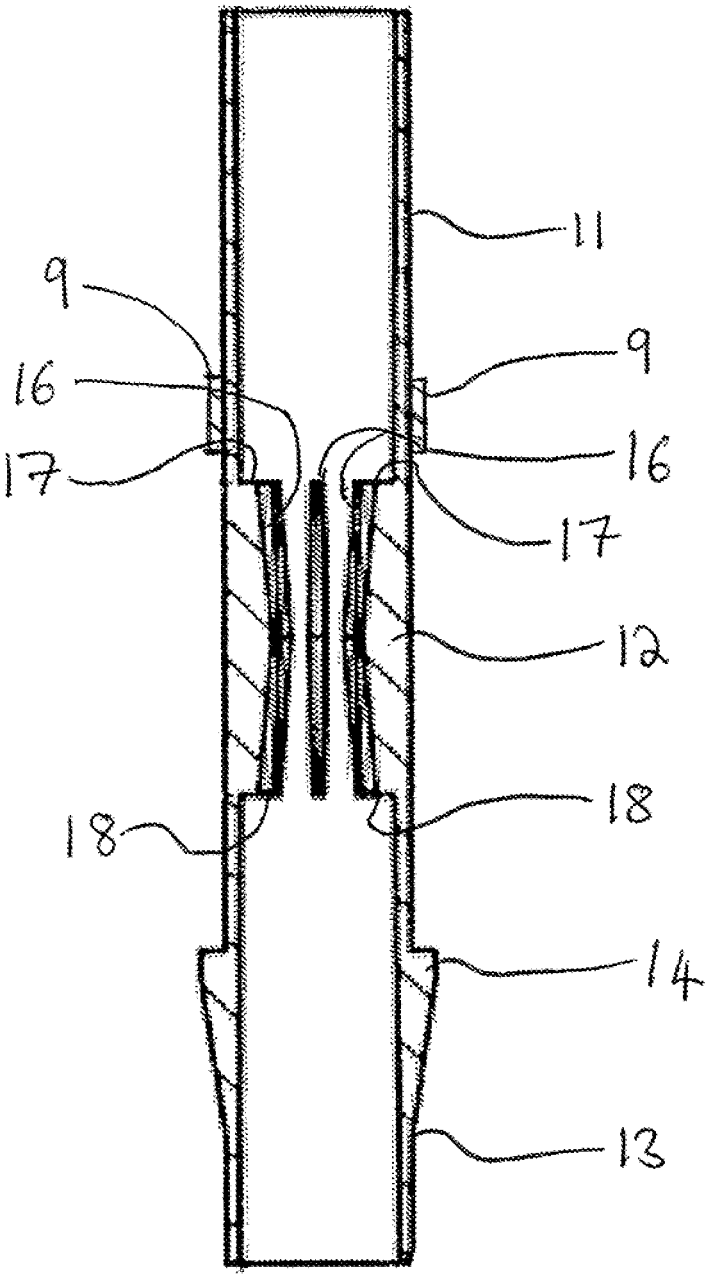
FIG. 2*b* is a cross-sectional view of the mounting member.

The mounting member 1 is shown in more detail in FIGS. 2*a* and 2*b*. The mounting member 1 comprises a tube 7 having a circular outer surface 8. Located diametrically opposite each other on the surface 8 are two lugs 9. The tube 7 has a central portion 12, a first end portion 11 and second end portion 13 at the opposite end of the tube 7 from the first end portion 11, adapted to be engaged with an elongate tubular member. The lugs 9 are located on the first end portion 11. A flange 14 is located on the external surface of the second end portion 13. The flange 14 may be supported by a number of strengthening ribs 15.

Internally, the tube 7 has a number of ribs 16 located in the central portion 12. The ribs 16 define a shoulder 17 at the internal end of the tube portion 11 and define a shoulder 18 at the internal end of the tube portion 13.

Figure 3A:
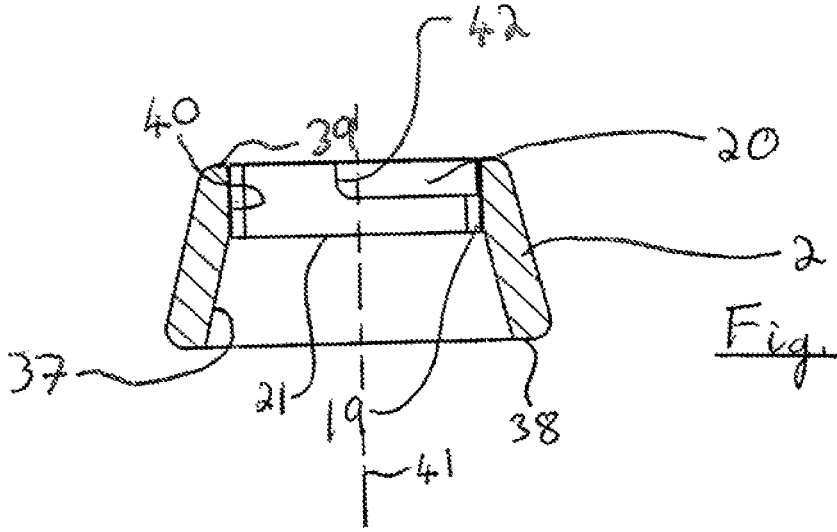
FIG. 3*a* is a cross-sectional view of a collar for use with the coupling system shown in FIG. 1.
Figure 3B:
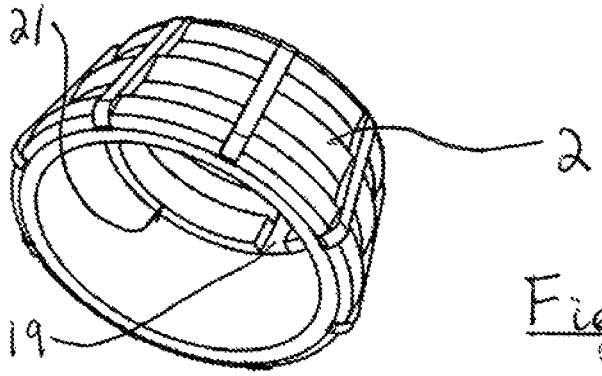
FIG. 3*b* is a perspective view of the collar shown in FIG. 3*a;*
Figure 3C:
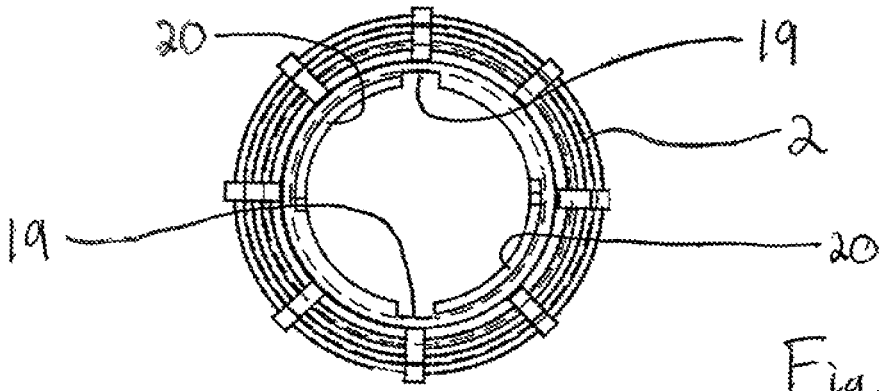
FIG. 3*c* is an end view of the collar shown in FIG. 3*a;*

Each collar 2 has two slots 19 through which the lugs 9 can pass (see also FIGS. 3*a* to 3*c*). A shoulder 21 within the collar 2 prevents the collar 2 passing past the lugs 9 unless the orientation of the collar 2 is such that the lugs 9 align with the slots 19. The collar 2 also has two channels 20 adjacent to the slots 19, such that the lugs 9 may be located in the channels 20 by relative rotation between the collar 2 and the mounting member 1 when the lugs 9 are at end 22 of the slots 19.

An internal side wall 37 of the collar 2 extends outwardly from the shoulder 21 to end 38 of the collar 2 so that the side wall 37 is at an oblique angle to central longitudinal axis 41 of the collar 2, as shown in FIG. 3*a*. An internal side wall 40 extends upwardly from the shoulder 21 to end 39 of the collar 2 and the side wall 40 is substantially parallel to the central longitudinal axis 41 of the collar 2. The internal diameter of the side wall 40 is such that it is a clearance fit over the outer surface 8.

Figure 4A:
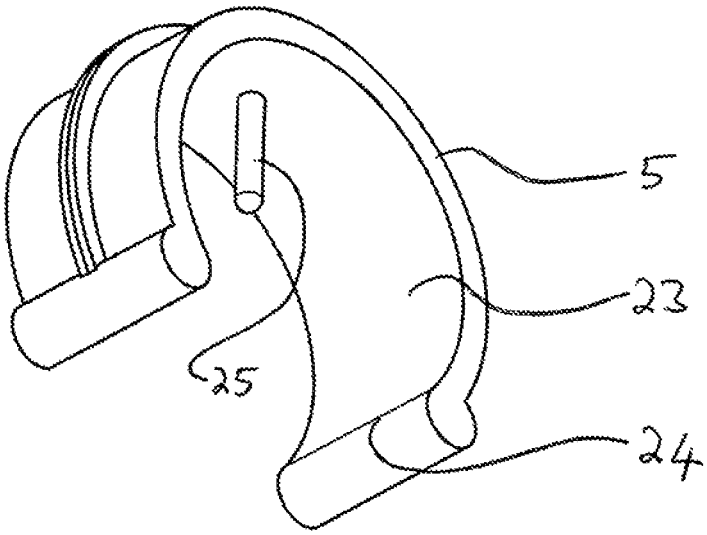
FIG. 4*a* is a perspective view from below of a securing clip for use with the coupling system shown in FIG. 1.
Figure 4B:
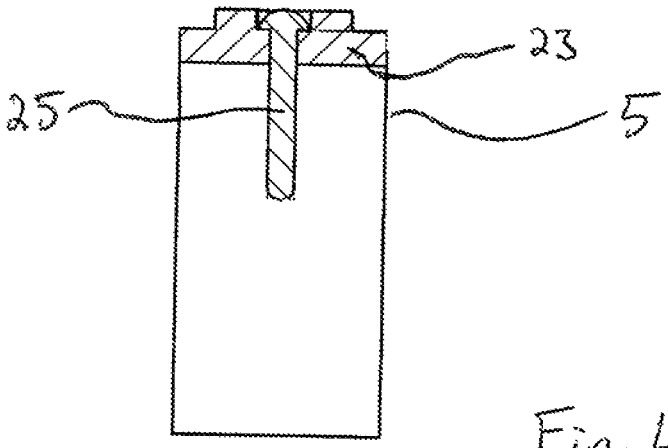
FIG. 4*b* is a cross-sectional view of the clip of FIG. 4*a;*
Figure 5:
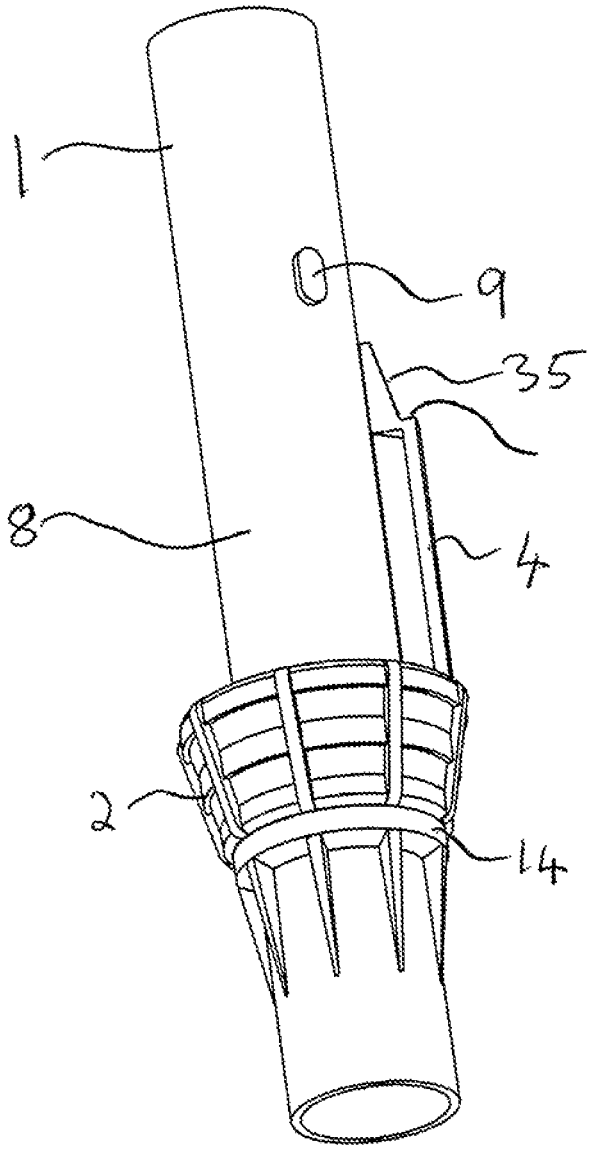
FIG. 5 is a perspective view from below of the mounting member with one collar and a blanking plate mounted on the mounting member.

The securing clip 5 is shown in more detail in FIGS. 4*a* and 4*b* and comprises an elastically deformable body portion 23 that is partially circular with an open end 24. The securing clip 5 also includes a securing device in the form of a pin 25 which extends out of the body member 23 in a radially inwardly direction relative to the cylindrical volume defined by the body member 23. Although the body member 23 is typically manufactured from a non-conducting material, such as a plastics material, the pin 25 is preferably a metal pin, and most preferably a stainless steel pin that extends through the body member 23. However, it is possible that the pin 25 may also be non-conducting. For example, the pin could be manufactured from a hard plastic, such as nylon or PTFE, a composite material such as a material comprising glass fibre and/or aramid fibres, or any other suitable non-conducting material.

FIGS. 5 to 8 show how the coupling system 10 may be assembled in a second configuration using two support members 3 and two blanking plates 4.

Firstly, one of the collars 2 is slid over portion 11 of the mounting member 1 with the end 39 of the collar 2 facing towards the flange 14. The slots 19 in the collar 2 are aligned with the lugs 9 such that the collar 2 can pass over the lugs 9 and moved along the tube portion 11 until the end 39 of the collar 2 rests on the flange 14. In this position, the internal side wall 37 of the collar 2 and the outer surface 8 define a wedge shaped circular gap between the collar 2 and the tube portion 11.

Each of the support members 3 has a body member 26 that defines a concave curved surface 27 that has the same curvature as the curvature of the outer surface 8 of the mounting member 1. Extending from the body member 26 in a direction away from the concave surface 27 is a tube portion 28 with a securing formation in the form of a through aperture 29 in the side wall of the tube portion 28. Preferably, the aperture is adjacent an end 30 at the opposite end of the tube portion 28 from the body member 26.

The body member 26 has a central portion 49 and opposite ends 31 and 32 on either side of the central portion 49. The ends 31, 32 of the body member 26 have a wedge shaped cross-sectional profile. The wedge shaped cross-sectional profile of the ends 31, 32 is the same size as the wedge shaped gap formed between the collar 2 and the tube portion 11. A shoulder 45 is located between the end 31 and the central portion 49 and another shoulder 46 is located between the end 32 and the central portion 49.

The blanking plate 4 is similar to the support member 3 but without the tube portion 28. Hence, the blanking plate 4 has a body member 33 that is similar in shape to the body member 26. It also has a curved concave surface 34 that is the same as the surface 27 and has the same curvature as the outer surface 8. In addition, the body member 33 also has a central portion 50 and opposite ends 35, 36 that have the same wedge shaped cross-sectional profile as the ends 31, 32. Shoulders 47, 48 are located between the central portion 50 and the respective ends 35, 36.

An end 36 of the blanking piece 4 is inserted into the wedge shaped gap formed between the internal side wall 37 of the collar 2 and the outer surface 8 of the mounting member 1, such that the concave surface 34 of the blanking plate 4 is located against surface 8 of mounting member 1 and the shoulder 48 butts against the end 38 of the collar 2.

Figure 6:
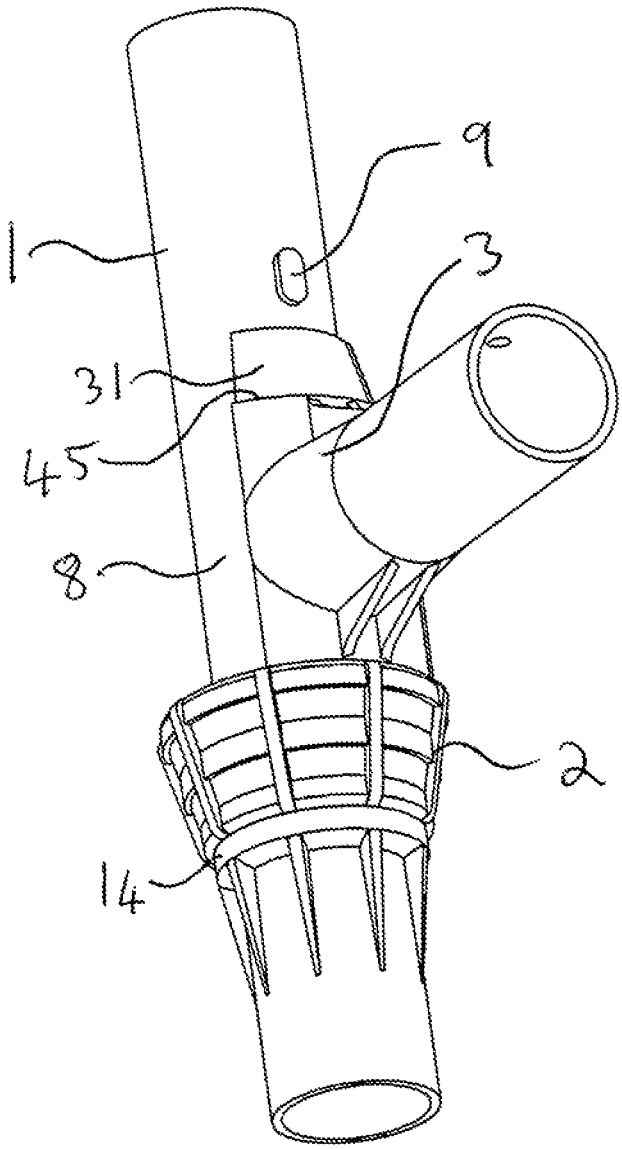
FIG. 6 is a perspective view similar to FIG. 5 but with a support member also mounted on the mounting member.

In the next stage, a first support member 3 is engaged with the mounting member 1 by inserting end 32 into the wedge shaped gap between the surface 37 and the surface 8, as shown in FIG. 6, so that the shoulder 46 butts against end 38 of the collar 2.

Figure 7:
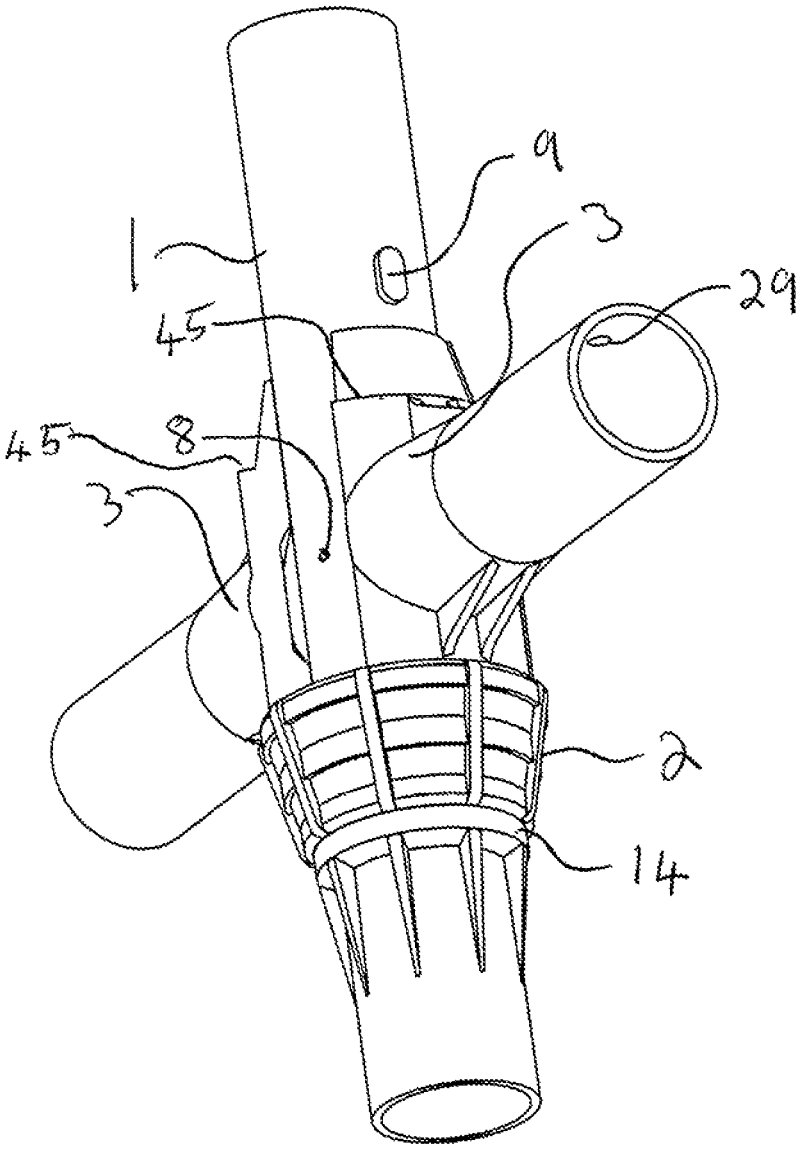
FIG. 7 is a perspective view similar to FIG. 6 but with another support member mounted on the mounting member.

As shown in FIG. 7, a second support member 3 is then also mounted on the mounting member 1 in the same manner as the first supporting member 3 by inserting end 32 into the space between surface 37 of the locking member 2 and surface 8 of the mounting member 1. The second support member 3 is mounted so that it is diametrically opposite the first support member 3.

A second blanking plate 4 is then mounted on the mounting member 1 in a similar manner to the first blanking plate 4 by mounting it on the mounting member 1 diametrically opposite the first blanking plate 4 in the space between the two support members 3, as shown in FIG. 7.

Figure 8:
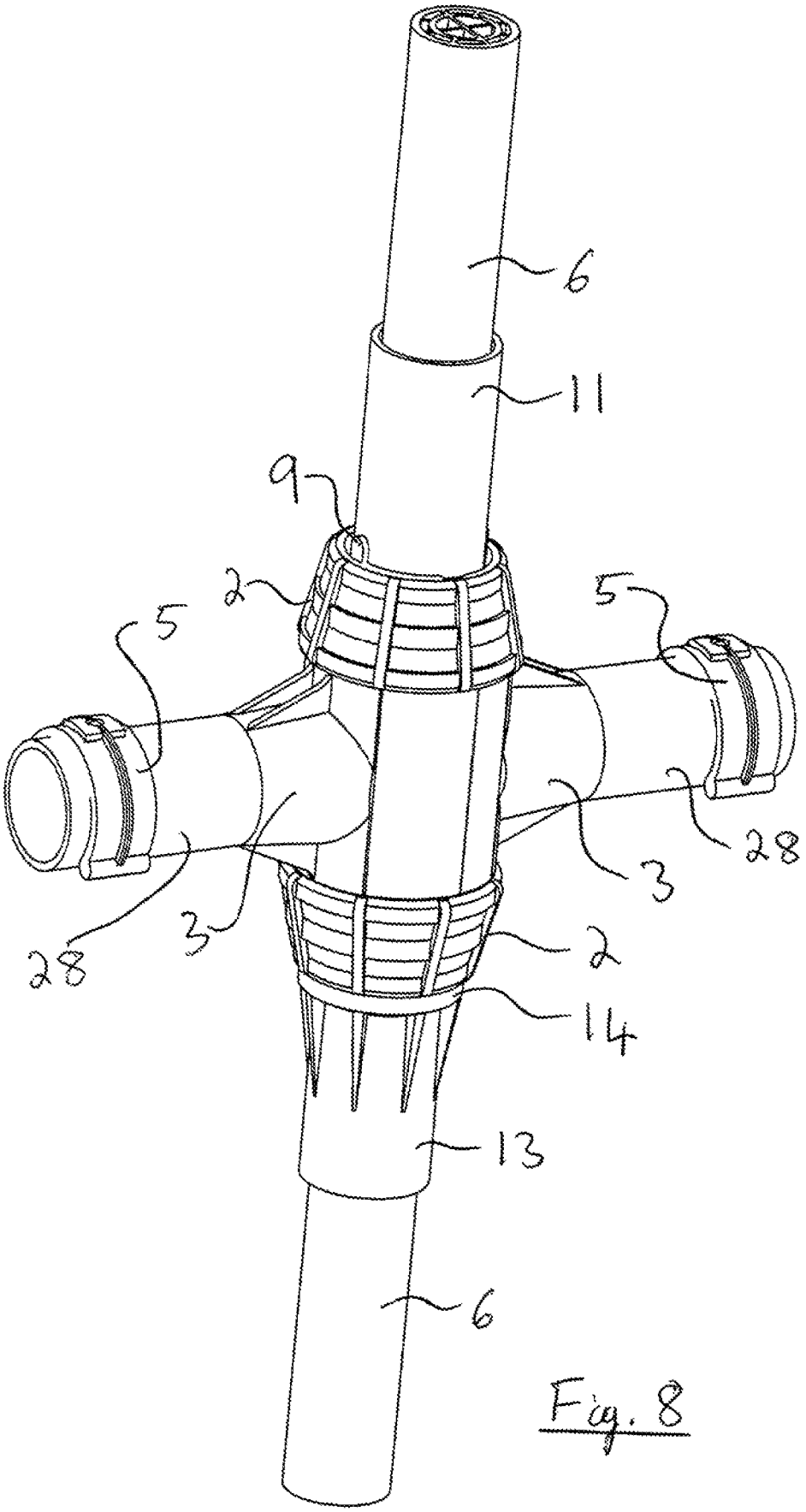
FIG. 8 is a perspective view similar to FIG. 7 with the mounting member rotated and another blanking plate and another collar mounted on the mounting member and forming a second configuration of the mounting system with two diametrically opposite support members.

A second collar 2 is then slid over the end 11 with the end 38 of the collar 2 facing towards the flange 14. The slots 19 are aligned with the lugs 9 so that the second collar 2 passes over the lugs 9 and the end 38 of the second collar 2 butts against the shoulders 45 on the support members 3 and the shoulders 47 on the blanking plates 4 such that the ends 31 of the support members 3 and the ends 35 of the blanking plates 4 are located in the gap between the second collar 2 and the outer surface 8. When the end 38 butts against the shoulders 45 and the shoulders 47, the collar 2 can then be rotated relative to the mounting member 1 so that the lugs 9 enter the channel 20. Fully rotating the collar 2 until the lugs 9 butt against end 42 of the channel 20 locks and secures the collar 2 to the mounting member 1 and the support members 3 and the blanking plates 4 to the mounting member 1, as shown in FIG. 8.

Vertical scaffold tubes 6 can then be inserted into ends 11, 13 of the mounting member 1. In addition, horizontal scaffold tubes 6 (not shown) may also be inserted into tube portions 28 of the support members 3 and secured in position by securing clips 5. In operation, the pin 25 of the securing clip 5 passes through the hole 29 in the tube portions 28 and engages with a hole (not shown) in the scaffold tube 6 that is aligned with the hole 29 to permit the pin 25 to pass through the hole 29 and penetrate into the aligned hole in the scaffold tube 6.

Figure 9:
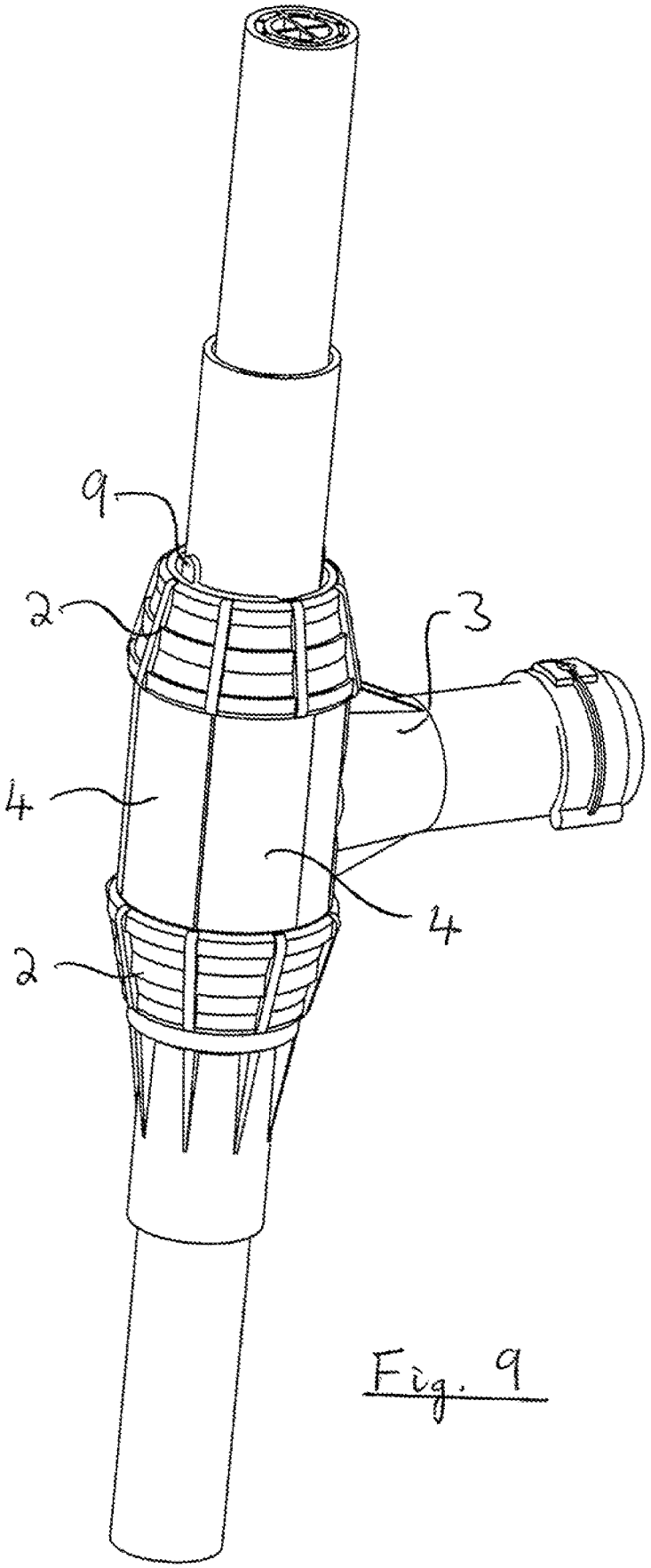
FIG. 9 shows a third configuration of the coupling system with one support member and two scaffolding tubes mounted on the mounting member.

FIG. 9 shows a third configuration of the coupling system 10 in which one support member 3 is mounted on the mounting member 1 together with three blanking plates 4 (only two shown). For the third configuration shown in FIG. 9, the assembly is the same as for the second configuration described above and shown in FIGS. 5 to 8, except that one of the support members 3 is replaced by a blanking plate 4.

Figure 10:
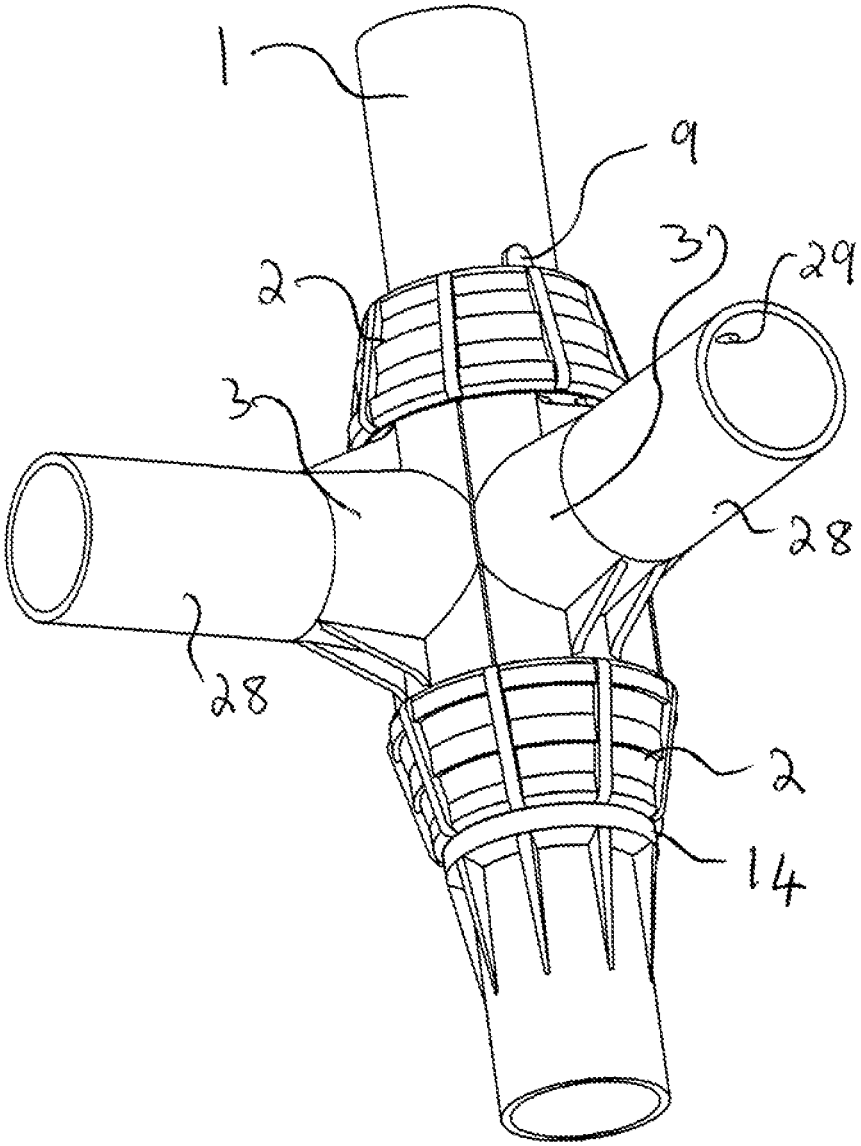
FIG. 10 is a perspective view of a fourth configuration of the coupling system with two adjacent support members.

FIG. 10 shows a fourth configuration of the coupling system 1 in which two support members 3 are mounted on the mounting member 1 adjacent to each other to form a right angle. This configuration is similar to the configuration shown in FIGS. 5 to 8 except that the position of one of the blanking members 4 and one of the support members 3 are interchanged so that the two blanking members 4 are adjacent to each other and the two support members 3 are adjacent to each other. Again, the assembly of the coupling system 10 to achieve the configuration shown in FIG. 10 is identical to the assembly of the second configuration of the coupling system, except that the locations of one blanking plate 4 and one support member 3 on the mounting member 1 are interchanged.

Figure 11:
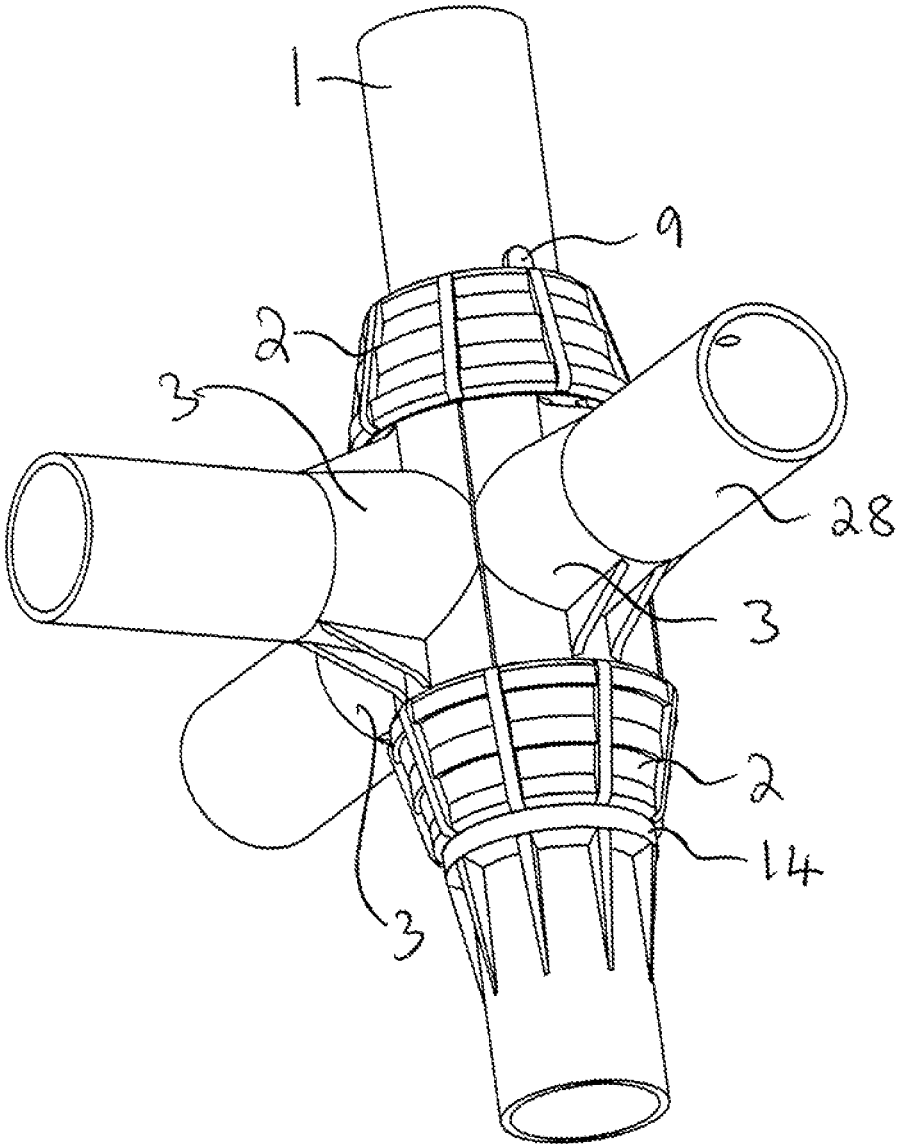
FIG. 11 is a perspective view of the first configuration rotated 180° relative to FIG. 1.

FIG. 11 shows the coupling system 10 of the first configuration shown in FIG. 1 fully assembled. The assembly procedure for the first configuration shown in FIGS. 1 and 11 is the same as for the second configuration, except that one of the blanking pieces in the second configuration is replaced by a support member 3.

Figure 12:
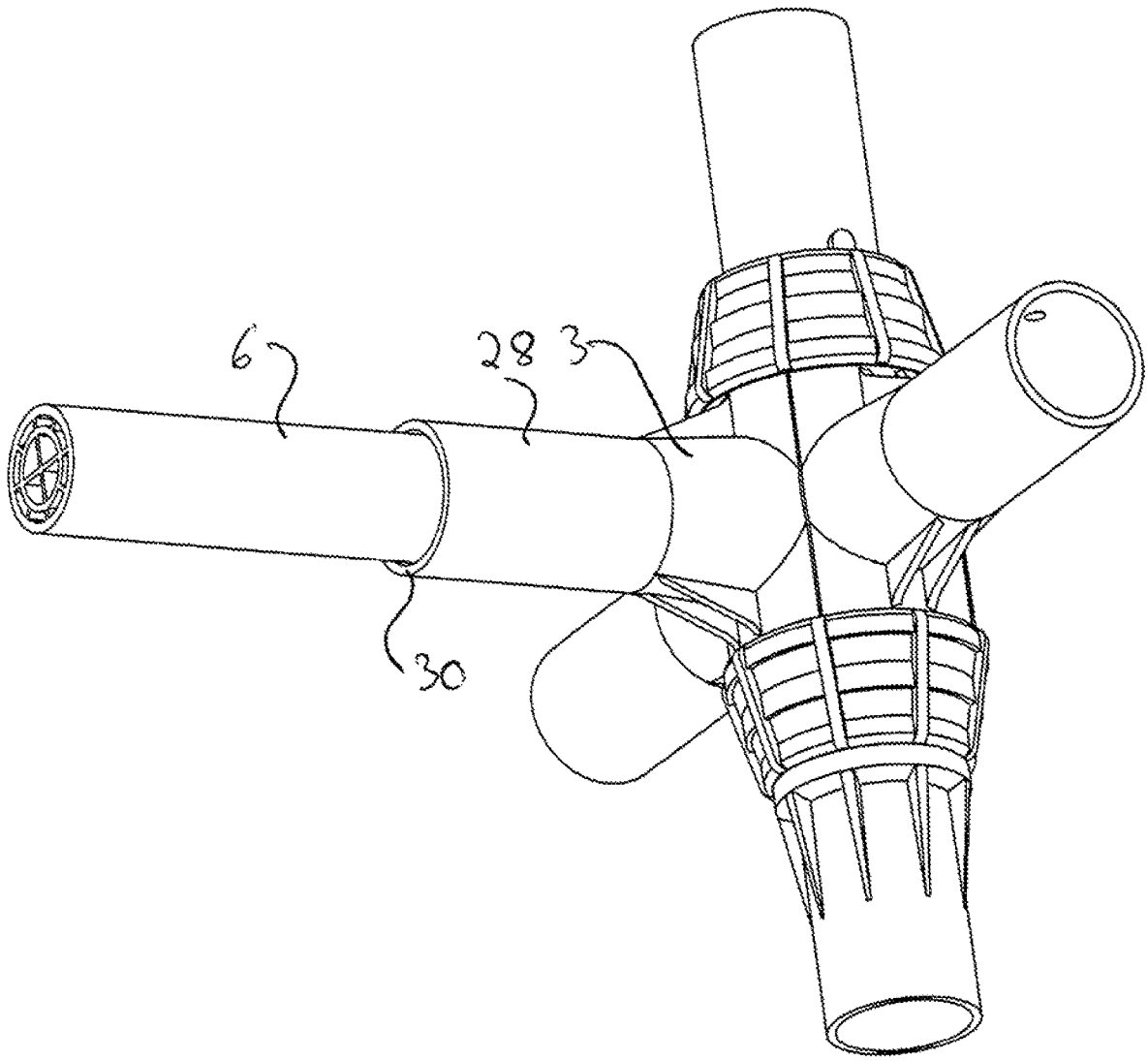
FIG. 12 is a perspective view of the first configuration showing a scaffolding tube mounted on one of the support members.

FIG. 12 shows the assembled first configuration of FIG. 11 with a scaffold tube 6 inserted into the end 30 of the tube portion of one of the support members 3. The tube 6 is inserted into the tube portion 28 until it buts against internal end wall 50 on the support member 3. After the tube 6 has been inserted into the tube portion 28, one of the securing clips 5 is located over the tube portion 28 such that the pin 25 penetrates through the hole 29 in the portion 28 and penetrates into a corresponding hole in the tube 6 that is aligned with the hole 29. This secures the tube 6 to the support member 3, as shown in FIG. 13.

Figure 13:
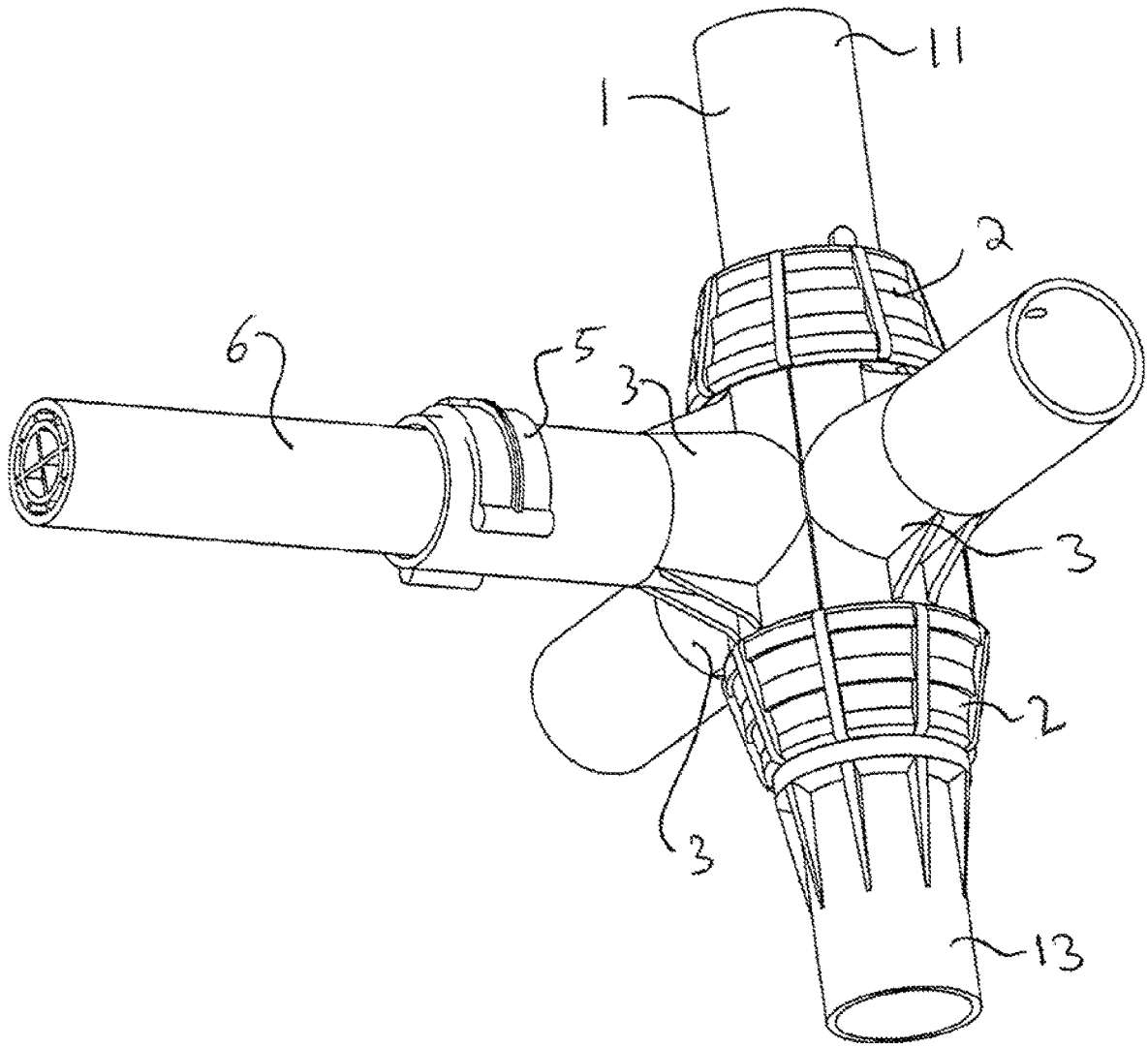
FIG. 13 is a perspective view similar to FIG. 12 showing a securing clip engaged with the one support member and the scaffolding tube.
Figure 14:
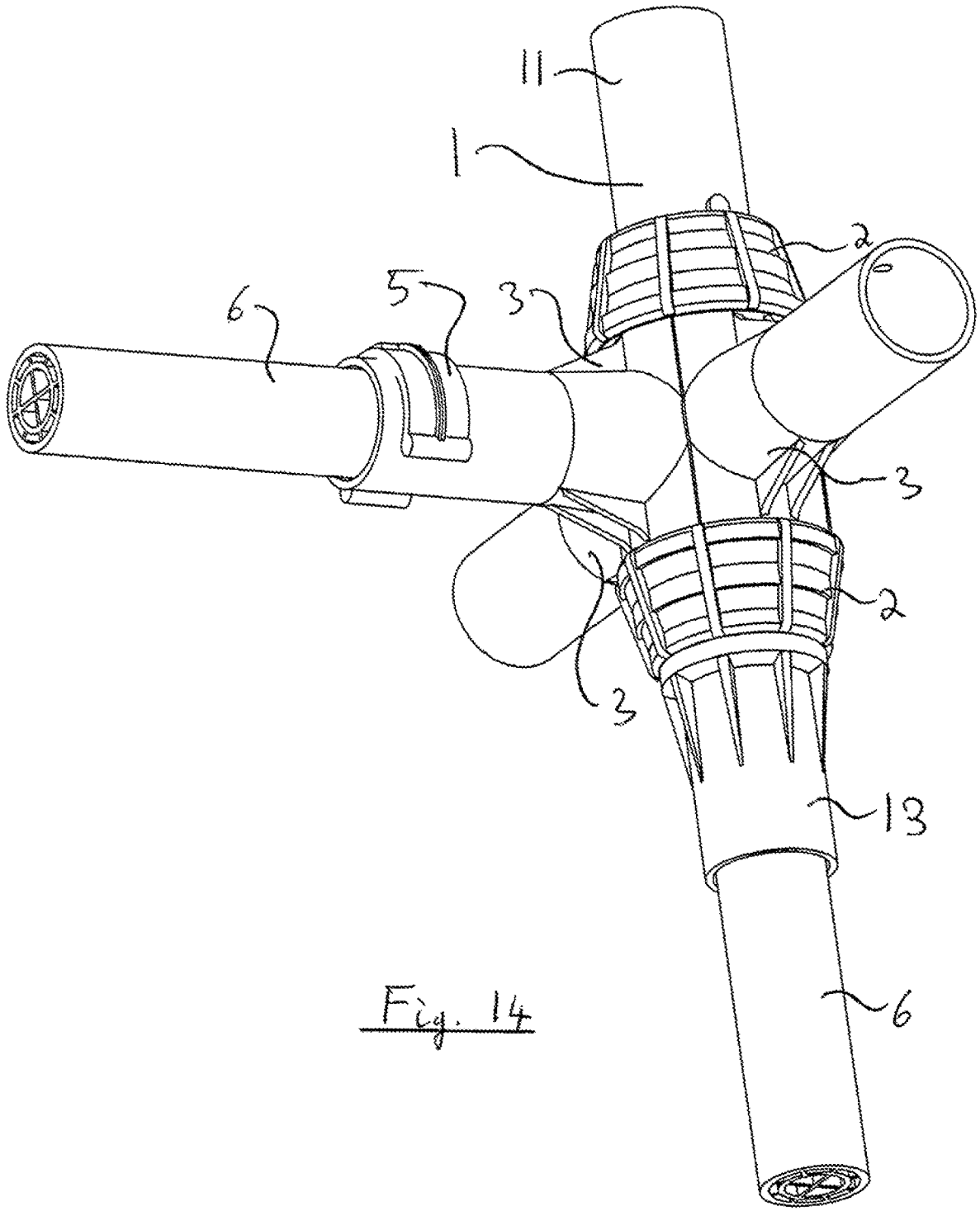
FIG. 14 is a perspective view similar to FIG. 13 with a second scaffolding tube mounted in a lower end of the mounting member.
Figure 15:
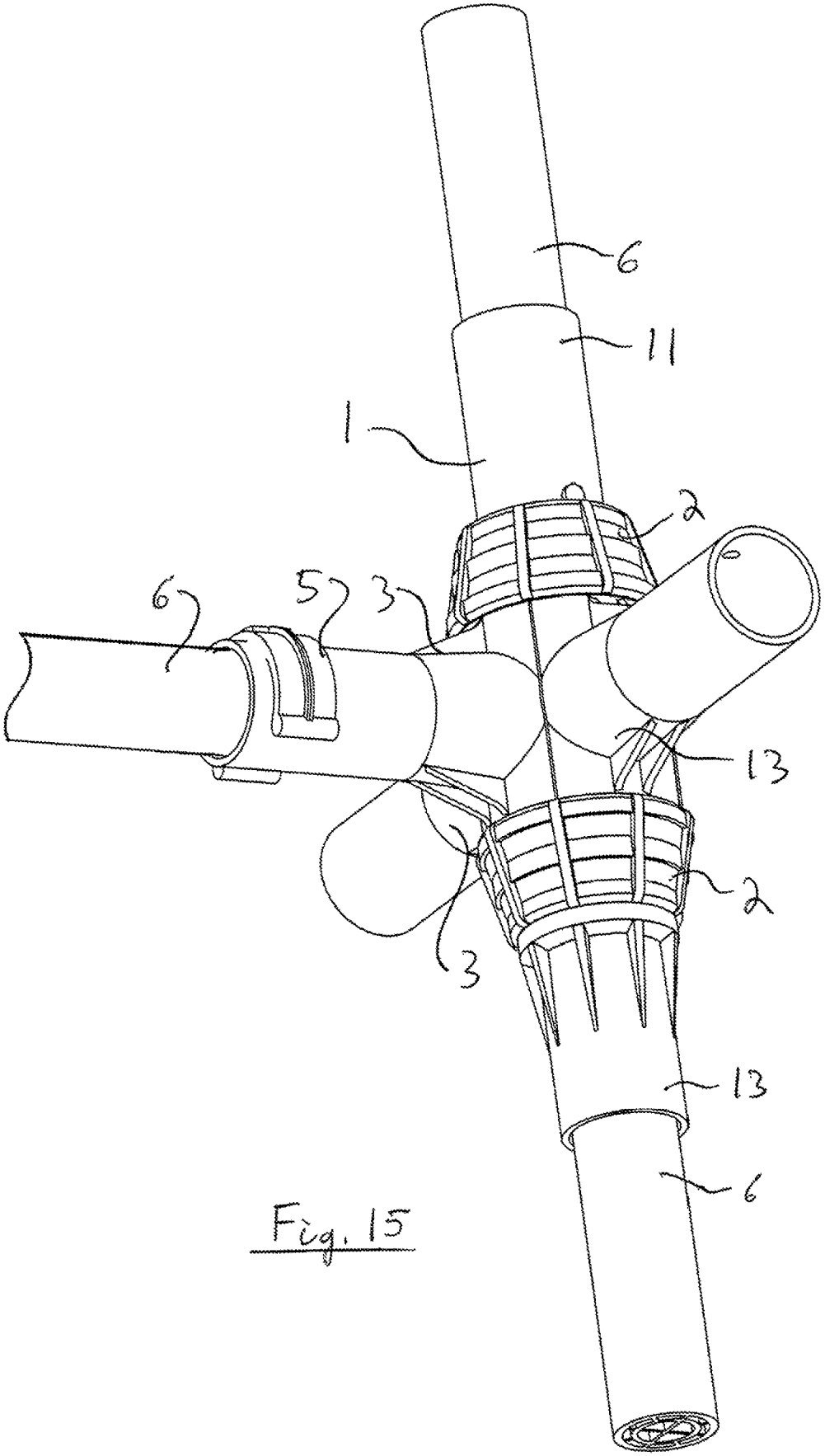
FIG. 15 is a perspective view similar to FIG. 14 a third scaffold tube mounted in an upper end of the mounting member.

FIG. 14 shows the configuration of FIG. 13 with the addition of another scaffold tube 6 inserted into the tube portion 13 of the mounting member 1. FIG. 15 shows the first configuration shown in FIG. 14 but with the addition of a tube 6 inserted into the tube portion 11 of the mounting member 1.

Hence, by inserting a tube scaffold tube 6 into each of the support members 3 and into the tube portions 13, 11 of the mounting member 1, it is possible to interconnect five scaffold tubes 6 to form a junction of the scaffold tubes 6 using the coupling system 10 in the first configuration. In addition, if four support members 3 are provided on the mounting member 1 it would be possible to interconnect six scaffold tubes 6 using the coupling system 10.

Figure 16:
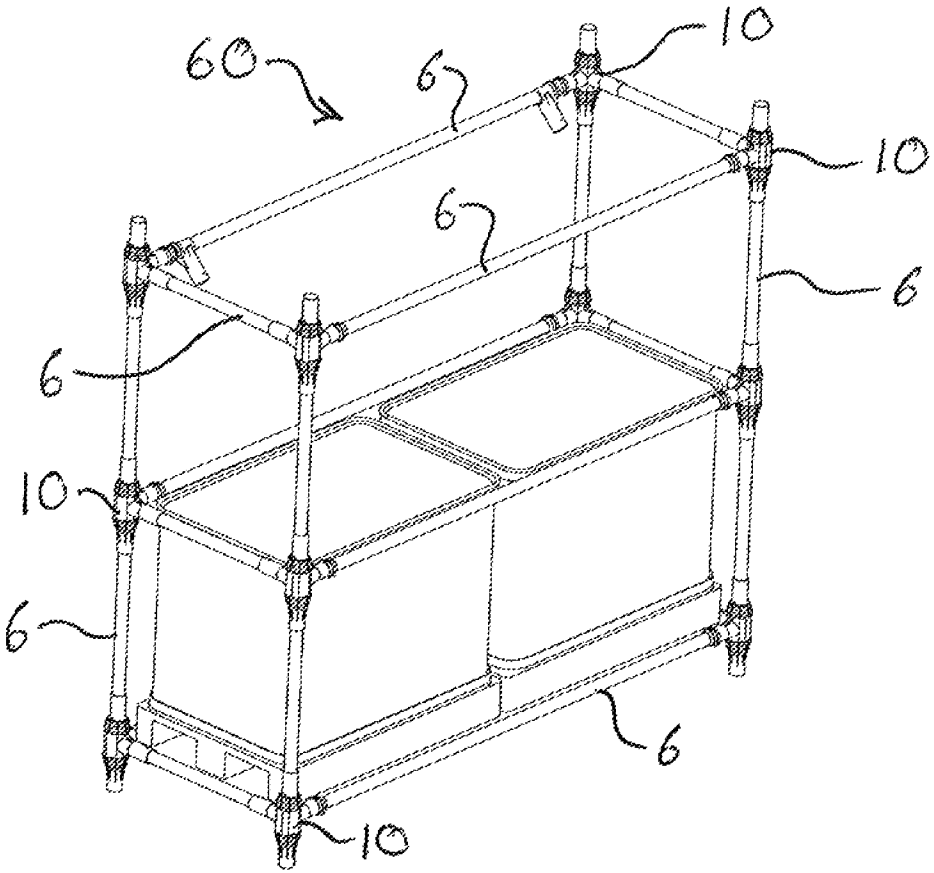
FIG. 16 is a perspective view of a scaffold bay constructed using a number of coupling systems using the fourth configuration shown in FIG. 10.

FIG. 16 shows an example of a scaffold bay 60 that has been erected using twelve coupling systems 10 with each coupling system 10 in the fourth configuration shown in FIG. 10. The coupling systems 10 are used to interconnect twelve horizontal scaffold tubes 6 and eight vertical scaffold tubes 6 to form the scaffold bay 60.

Figure 17A:
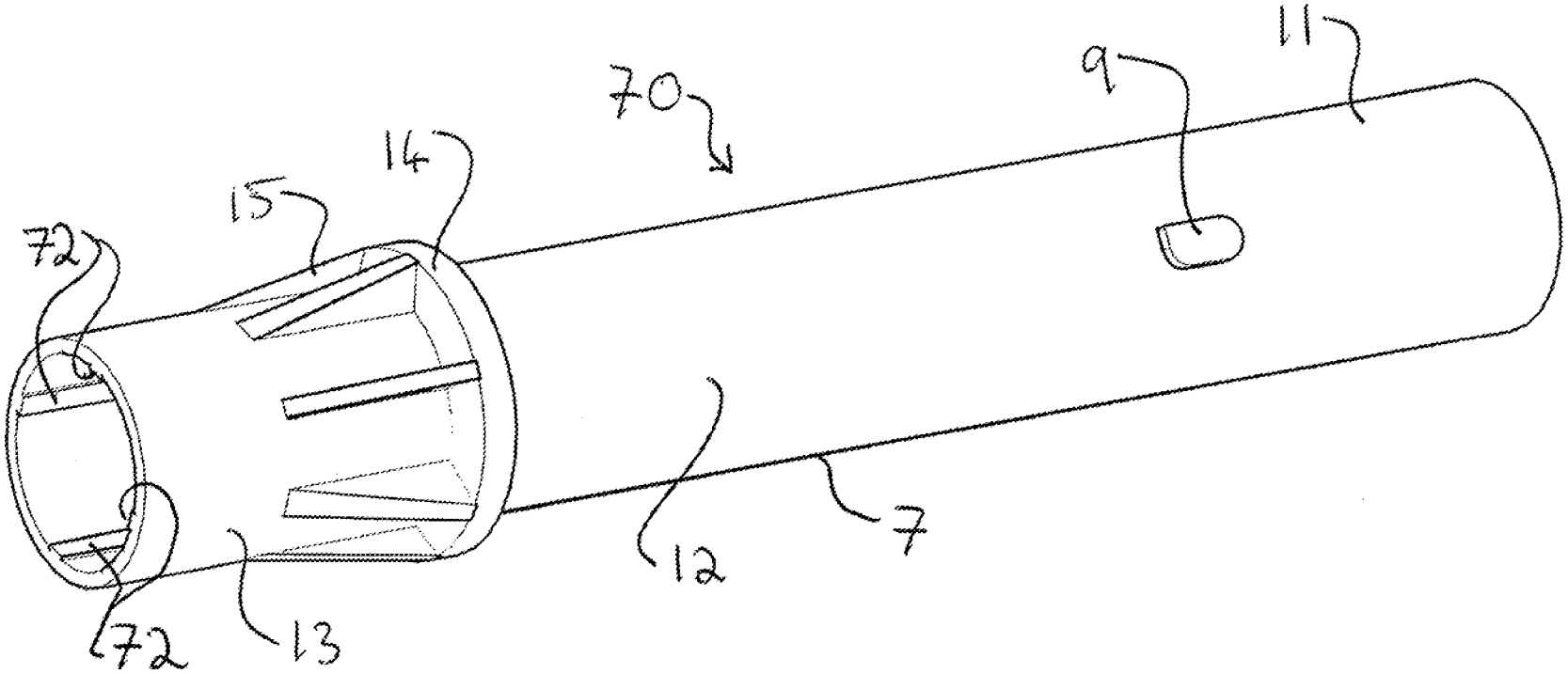
FIG. 17*a* is a perspective view from below of an alternative mounting member for use with the coupling system shown in FIG. 1.
Figure 17B:
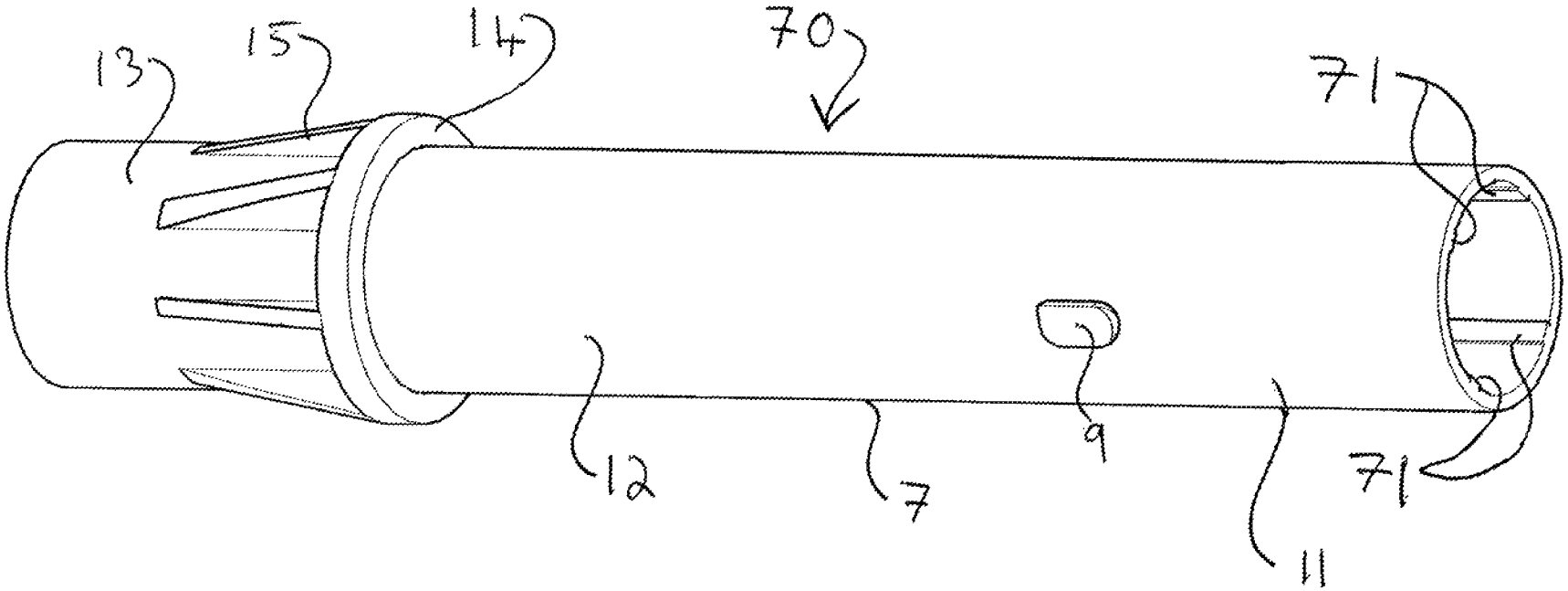
FIG. 17*b* is a perspective view from above of the alternative mounting member.
Figure 18A:
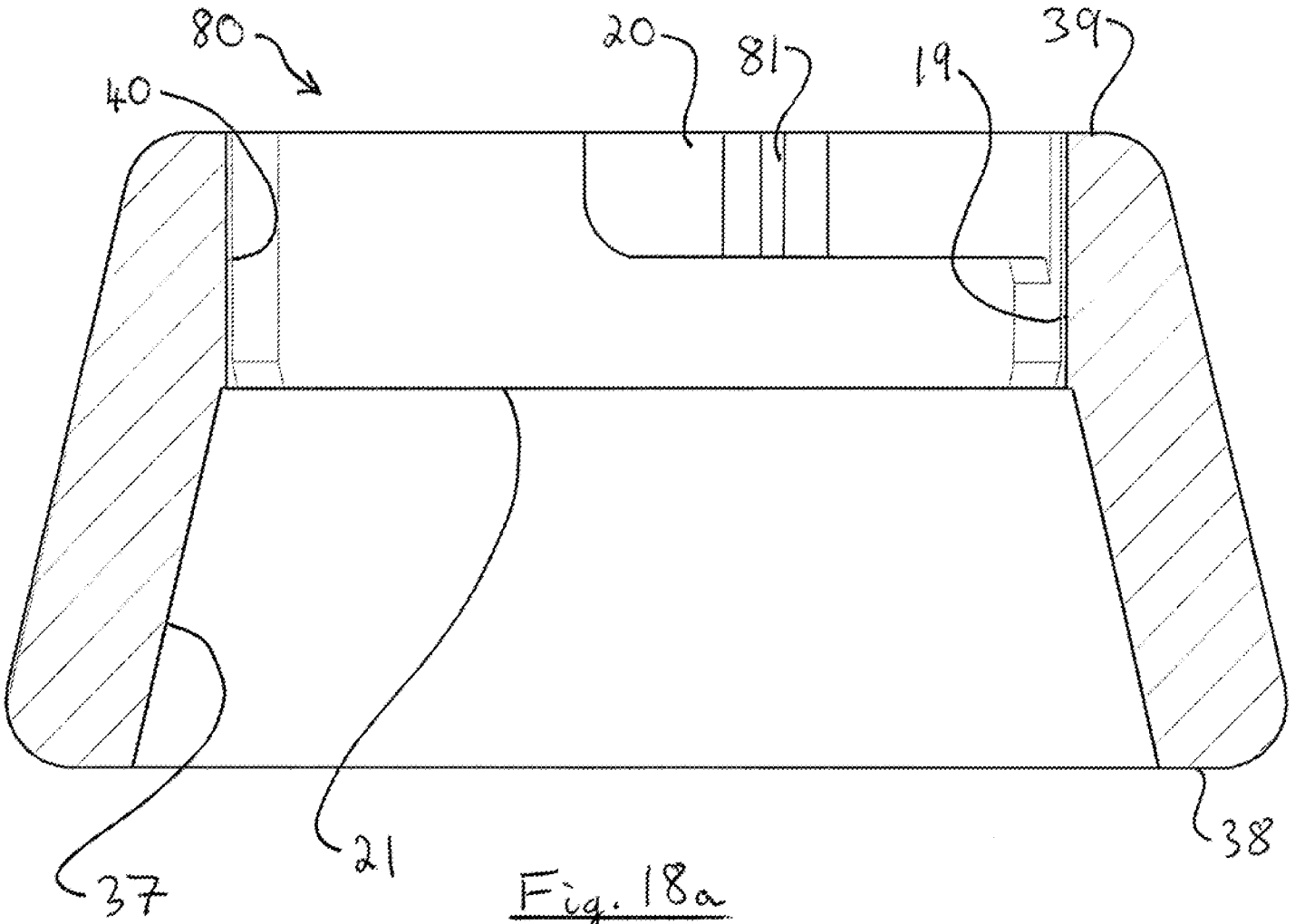
FIG. 18*a* is a cross-sectional view of an alternative collar for use with the coupling system shown in FIG. 1.
Figure 18B:
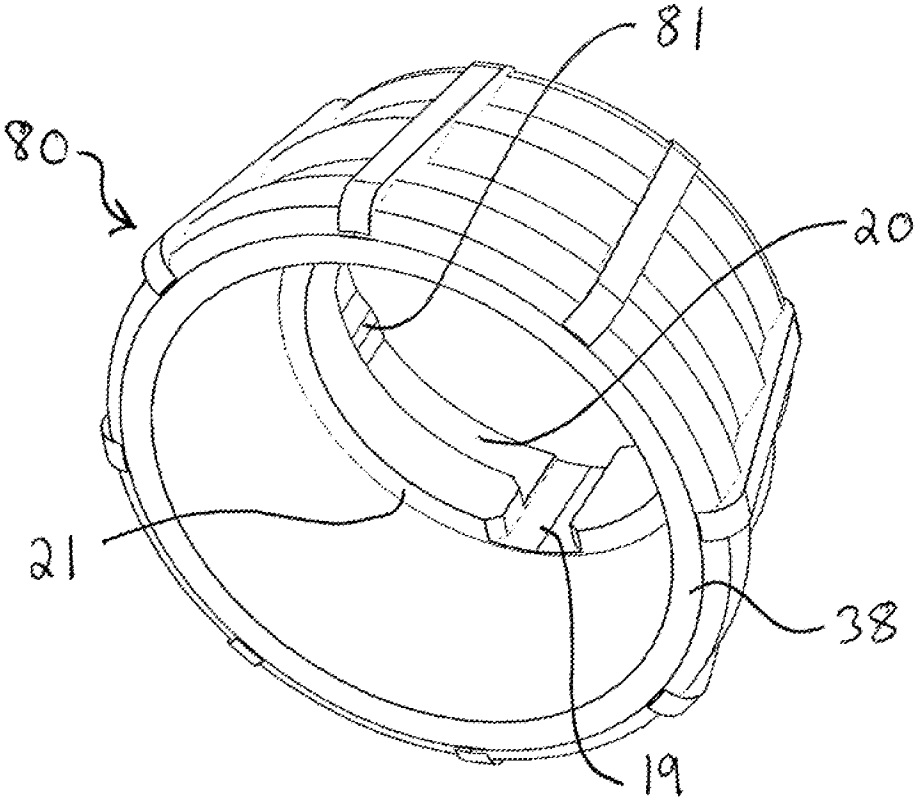
FIG. 18*b* is a perspective view of the alternative collar.
Figure 18C:
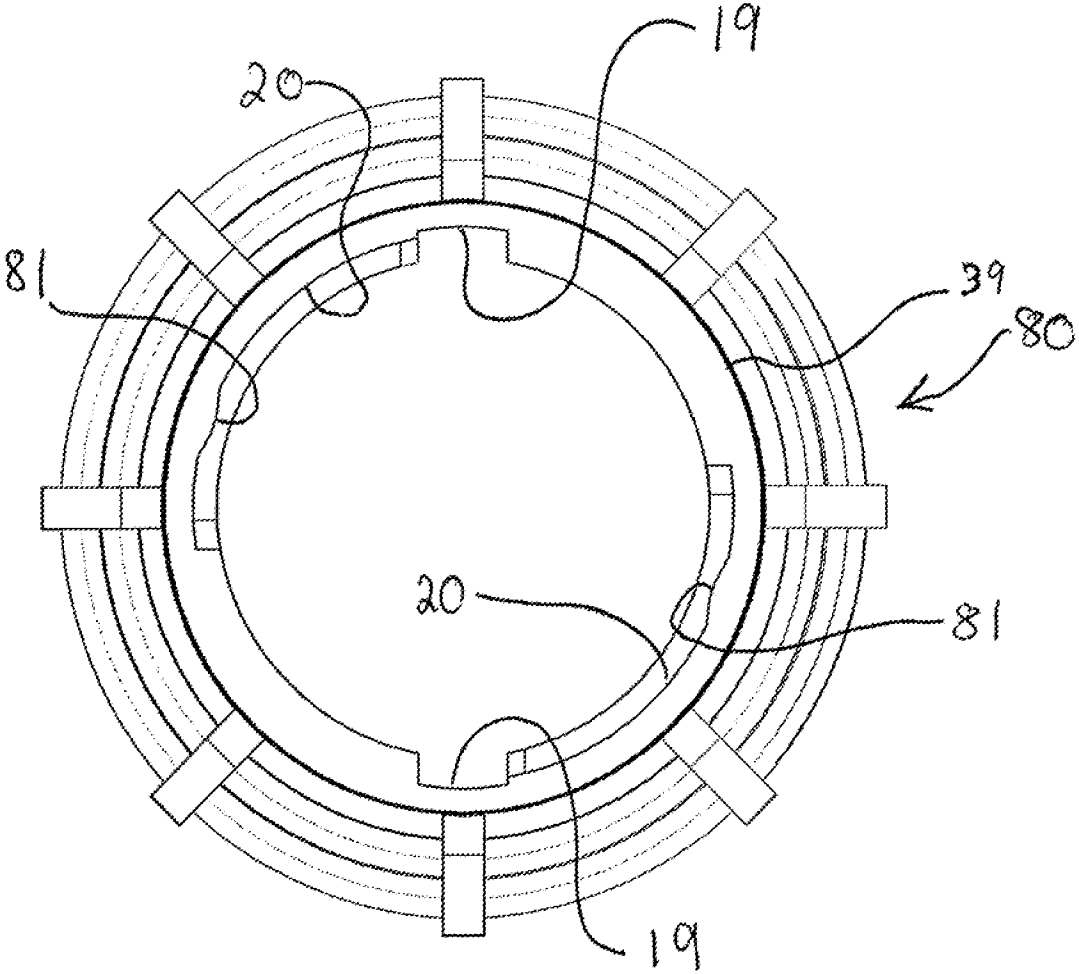
FIG. 18*c* is an end view of the alternative collar.
Figure 19:
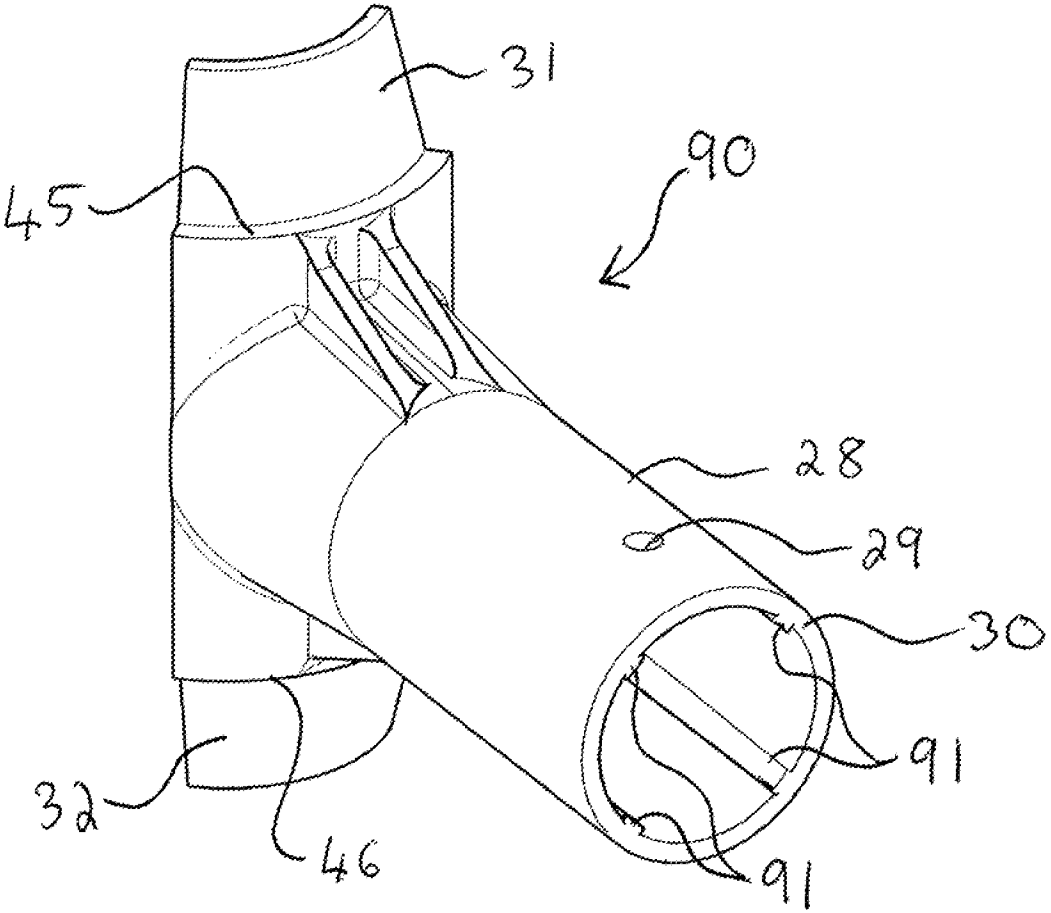
FIG. 19 shows an alternative support member for use with coupling system shown in FIG. 1.

FIGS. 17*a* and 17*b* show an alternative mounting member 70, FIGS. 18 to 18*c* show an alternative collar 80 and FIG. 19 shows an alternative support member 90. Each of the alternative mounting member 70, the alternative collar 80 and the alternative support member 90 can be used in the system shown in FIG. 1 and described above as a replacement or substitute in place of the mounting member 1, the collars 2 and the support member 3. Each of the alternative mounting member 70, the alternative collar 80 and the alternative support member 90 are similar to the mounting member 1, the collar 2 and the support member 3, respectively, and identical parts are labelled with the same reference numerals.

The alternative mounting member 70 is identical to the mounting member 1 except for internal ribs 71, 72 that extend along the length of the inside of each of the ends 11, 13, respectively, of the tube 7. The end 11 has a number of internal formations in the form of four internal ribs 71 and the end 13 similarly has four internal ribs 72. The alternative support member 90 is identical to the support member 3 except for four internal ribs 91 extending along the length of the tube portion 28. Preferably, the ribs 71, 72, 91 are spaced equidistantly around the inside of the tube 7 and the tube portion 28, respectively. The mounting member 70 and the support member 90 operate and are used in the same manner to the mounting member 1 and the support member 3 described above.

A drawback of the relatively long tube 7 and tube portion 28 is that in order to manufacture the mounting member 1 and the support member 3 using an injection moulding process, it is necessary to use relatively expensive and complicated tooling with collapsible cores in order to mould the tube 7 and the tube portion 28. This is necessary to ensure that the internal surface of the tube 7 and the tube portion 28 are cylindrical. If less expensive injection moulding tooling is used to mould the tube 7 and the tube portion 28, it is not possible to obtain a cylindrical internal surface of the tube 7 and the tube portion 28 as the internal surfaces need to have a draught angle so that the internal surfaces taper (or flare) outwardly towards their open ends to permit release and removal of the moulding tool cores from the inside of the tube 7 and the tube portion 28.

However, this tapering outwardly of the internal cross-section of the tube 7 and the tube portion 28 has the disadvantage that it results in a gap between the scaffold tubes 6 and the internal surface of the tube 7 and the tube portion 28 at their outer ends, when the tubes 6 are inserted into the tube 7 and the tube portion 28. This gap can result in excessive lateral movement or play between the tubes 6 and the tube 7 or tube portion 28.

However, the mounting member 70 and the support member 90 mitigate this problem by providing the four ribs 71, 72, 91 on the internal surface of the tube 7 and the tube portion 28, respectively. Although the internal surfaces of the tube 7 and tube portion 28 between the ribs 71, 72, 91 have a normal draught angle suitable for use with a conventional non-collapsible core, the internal surfaces of the ribs 71, 72, 91 that face radially inwards have a zero or minimal draught angle. Hence, lateral movement or play between the tubes 6 and the tube 7 or tube portion 28 at the outer ends of the tube 7 and tube portion 28 are minimised by the presence of the ribs 71, 72, 91, respectively.

Although the internal surfaces of the ribs 71, 72, 91 that face radially inwardly have a zero or minimal draught angle, the circumferential width of the ribs 71, 72, 91 tapers towards the outer ends of the tube 7 and the tube portion 18. Therefore, this still permits a non-collapsible injection moulding core to be withdrawn from the tube 7 and the tube portion 28.

The alternative collar 80 is identical to the collar 2 except for a protrusion 81 formed in each of the channels 20. The protrusions 81 act as detents to retain each of the lugs 9 in position at end 42 of their respective channels 20. The protrusions 81 are designed such that during assembly the lugs and/or the side walls of the channels 20 elastically deform to permit the lugs 9 to move in their respective channel 20 past the respective protrusion 81 to enter the portion of the channel 20 between the protrusion 81 and the end 42. The protrusion then acts as detent mechanism to help retain the lug at the end 42 and minimise the risk of the collar 80 accidentally rotating relative to the mounting member 1, 70 and the lug 9 disengaging from the channel 20.

However, the collar 80 can be deliberately disengaged from the mounting member 1, 70 by applying sufficient rotational force between the collar 80 and the mounting member 1, 70 so that the lug 9 is forced past the protrusion 81 away from the end 42. Typically, the gap between the protrusions 81 and the ends 42 of the channels 20 is greater than or equal to the width of the lug 9 in the mounting member 1, 70. Preferably the gap is approximately equal to the width of the lug 9.

Hence, the invention has the advantage of permitting multiple scaffolding tubes 6 to be interconnected to form a scaffolding structure. The invention also has the advantage that by using the support members 3, it is possible to use a scaffold tube 6 of any length and does not require the scaffold tube 6 to have special end fittings in order to enable the scaffold tube 6 to be interconnected.

In addition, the invention enables a non-conducting scaffolding tube to be coupled together (or interconnected) without requiring compressive clamps on the side walls of the scaffolding tubes 6.

I claim:

1. A coupling system for coupling together elongate tubular members, the coupling system comprising:

a mounting member having an outer surface;

a first locating member mounted on the mounting member;

a second locating member adapted to be mounted on the mounting member, in use;

one or a plurality of support members, each support member comprising a body member having a central portion and first and second opposing ends, and defining a concave surface, and a tube portion extending from the body member; and wherein the concave surface of each support member is adapted to be engaged with the outer surface of the mounting member and the first and second opposing ends of the body member of each support member are adapted to be engaged with the first locating member and the second locating member, respectively, to mount the support member on the mounting member; and the tube portion of each support member is adapted to be engaged with an elongate tubular member of the elongate tubular members, in use; and wherein the second locating member comprises a detent that engages with the mounting member to secure the second locating member to the mounting member and inhibit disengagement of the second locating member, in use;

wherein the second locating member comprises a channel and the mounting member comprises a lug adapted to engage with the channel; and wherein the detent comprises a protrusion in the channel and an elastic deformation of a portion of the second locating member permits the lug and channel to fully engage with each other.

2. A coupling system according to claim 1, wherein the one or the plurality of support members comprises at least two support members and the concave surfaces of each of the at least two support members can be engaged with the outer surface of the mounting member.

3. A coupling system according to claim 2, wherein the tube portions of each of the at least two support members extend from the mounting member at an angle to each other, in use.

4. A coupling system according to claim 1, further comprising one or a plurality of blanking members, each blanking member comprising a body member having a central portion and first and second opposing ends, and defining a concave surface, and wherein the one or the plurality of blanking members are adapted to be engaged with the outer surface of the mounting member in locations where the one or the plurality of support members are not engaged with the outer surface of the mounting member, in use.

5. A coupling system according to claim 1, wherein the lug is engaged with the channel by relative rotational movement between the second locating member and the mounting member.

6. A coupling system according to claim 1, wherein at least one of the first and second opposing ends of each support member is generally wedge-shaped with a thinner end of the wedge adapted to be inserted first into one of the first and second locating members.

7. A coupling system according to claim 1, wherein at least one of the first and second locating members is in the form of a collar adapted to be positioned over the mounting member.

8. A coupling system according to claim 1, wherein the mounting member comprises a tubular member.

9. A coupling system according to claim 1, wherein the one or the plurality of support members comprises at least two support members; and when the at least two support members are engaged with the mounting member, longitudinal axes of each of the tube portions intersect each other at an angle of a multiple of 90 degrees.

10. A coupling system according to claim 1, wherein the mounting member has a longitudinal axis, and the tube portion of each support member has a longitudinal axis, such that when each support member is mounted on the mounting member, the longitudinal axis of the mounting member and the longitudinal axis of the tube portion intersect each other at 90 degrees.

11. A coupling system according to claim 1, further comprising a securing device, and wherein the securing device is adapted to engage with a securing formation on at least one tube portion of the one or the plurality of support members to secure the elongate tubular member to the at least one tube portion, in use.

12. A coupling system according to claim 11, wherein the securing device comprises a pin and the securing formation comprises an aperture which is adapted to accept the pin and the pin is also adapted to engage with the elongate tubular member to secure the elongate tubular member to the at least one the tube portion.

13. A coupling system according to claim 1, wherein the tube portion of each support member comprises a number of internal formations extending along the length of the tube portion.

14. A coupling system according to claim 1, wherein the coupling system is manufactured from a non-metallic material.

15. A scaffolding system comprising a number of elongate tubular members and a coupling system, the coupling system couples together the elongate tubular members, and the coupling system comprises:

a mounting member having an outer surface;

a first locating member mounted on the mounting member;

a second locating member adapted to be mounted on the mounting member, in use;

one or a plurality of support members, each support member comprising a body member having a central portion and first and second opposing ends, and defining a concave surface, and a tube portion extending from the body member; and wherein the concave surface of each support member is adapted to be engaged with the outer surface of the mounting member and the first and second opposing ends of the body member of each support member are adapted to be engaged with the first locating member and the second locating member, respectively, to mount the support member on the mounting member; and the tube portion of each support member is engaged with one of the elongate tubular members, in use; and wherein the second locating member comprises a detent that engages with the mounting member to secure the second locating member to the mounting member and inhibit disengagement of the second locating member, in use;

wherein the second locating member comprises a channel and the mounting member comprises a lug adapted to engage with the channel; and wherein the detent comprises a protrusion in the channel and an elastic deformation of a portion of the second locating member permits the lug and channel to fully engage with each other.

* * * * *